US008596213B2

(12) United States Patent
Greenwood et al.

(10) Patent No.: US 8,596,213 B2
(45) Date of Patent: Dec. 3, 2013

(54) LAUNCH APPARATUS

(75) Inventors: Adam Greenwood, Cambridgeshire (GB); Oliver Winbolt, Cambridgeshire (GB)

(73) Assignee: Besenzoni S.p.A. (IT)

( * ) Notice: Subject to any disclaimer, the term of this patent is extended or adjusted under 35 U.S.C. 154(b) by 350 days.

(21) Appl. No.: 12/981,655

(22) Filed: Dec. 30, 2010

(65) Prior Publication Data

US 2011/0170951 A1 Jul. 14, 2011

(30) Foreign Application Priority Data

Jan. 8, 2010 (GB) ..... 1000201.2

(51) Int. Cl.
*B63B 23/30* (2006.01)

(52) U.S. Cl.
USPC ..... 114/365; 114/259

(58) Field of Classification Search
USPC ..... 114/369, 381, 259, 365, 366; 405/7
See application file for complete search history.

(56) References Cited

U.S. PATENT DOCUMENTS 5,884,885 A * 3/1999 Schmidt, Jr. ..... 248/346.01
7,293,521 B1 * 11/2007 Johns et al. ..... 114/259
7,707,955 B1 * 5/2010 Johns et al. ..... 114/259
7,735,441 B2 * 6/2010 Borum et al. ..... 114/259
2003/0192466 A1 10/2003 Trowbridge

FOREIGN PATENT DOCUMENTS

FR 2862275 5/2005
WO 2009084046 7/2009

OTHER PUBLICATIONS

Search Report for United Kingdom patent application GB 1000201.2.

* cited by examiner

*Primary Examiner* — Edwin Swinehart
(74) *Attorney, Agent, or Firm* — Barnes & Thornburg LLP

(57) ABSTRACT

There is provided launch apparatus (14) comprising at least one moveable arm (18) mountable on a water vehicle, wherein the moveable arm (18) carries a carriage means (20, 20') moveable between a first position in which the carriage means (20, 20') is capable of holding a personal watercraft (12), and a second position in which it forms a flat surface. The carriage means (20, 20') is pivotally moveable relative to the arm (18) and comprises at least one pair of pivotal members (28) which in the first position form a substantially v-shaped guide or channel for receiving a personal watercraft. The angle between the pivotal members (28) is adjustable to accommodate different shaped personal watercraft.

10 Claims, 5 Drawing Sheets

LAUNCH APPARATUS

FIELD OF INVENTION

This invention generally relates to the handling of tenders and other personal watercraft on pleasure boats. In particular, the invention relates to apparatus used to launch and stow tenders and other personal watercraft on the bathing platform of pleasure boats.

BACKGROUND OF INVENTION

Boats that are sufficiently large to carry smaller personal watercraft, require launch apparatus to deploy the personal watercraft into the water. Handling of a tender or other personal watercraft can be carried out in various ways. For example, a tender can be stored in a garage integral to the larger boat and deployed into the water on runners. A winch is then used to stow the tender or personal watercraft back in the garage. The tender can also be mounted on a hydraulic platform, which is lowered into the water for the purpose of launching the tender or personal watercraft. Another method of deployment is to use a crane or davit assembly. Each of these mechanisms compromises the overall package or functionality of the larger boat in one way or another. For example, a garage encroaches in the package space of the engine room, and therefore makes the packaging of a crew cabin very difficult aft of the engines. The hydraulic platform necessitates a reduction in hull length when compared with the overall boat length. This means that, for example, a boat that would be marketed as 65 ft long would only provide the accommodation of a boat with a 60 ft hull length. A crane is difficult to use and takes up a significant amount of space on the bathing platform, so even if the tender or personal watercraft is absent, the platform function is compromised.

SUMMARY OF THE INVENTION

In accordance with a first aspect of the invention, there is provided launch apparatus comprising at least one moveable arm mountable on a water vehicle, such as a boat, wherein the moveable arm carries a carriage means moveable between a first position in which the carriage means is capable of holding a tender, or other personal watercraft, and a second position in which it forms a flat surface. By having an adjustable carriage means, the carriage means can be folded after deployment of the tender or when not in use and so can form part of a bathing platform on a water vehicle. Typically the moveable arm is hydraulically operated, by a hydraulic ram or the like.

In certain embodiments, the nautical launch apparatus may comprise two moveable arms, the carriage means extending across both arms. This is of particular use where the apparatus is used on larger boats, typically over 55 ft.

The moveable arm or arms are preferably mountable externally on a boat hull so that the moveable arm does not occupy space within the hull or on a boat platform.

The carriage means, or carriage, may be pivotally moveable relative to the arm, pivoting between the first and second positions.

The carriage means may comprise at least one pair of pivotal members which in the first position form a substantially v-shaped guide or channel for receiving a tender. If desired, the angle between the pivotal members may be adjustable to accommodate different shaped tender hulls or personal watercraft.

Preferably the carriage means further comprises a second pair of pivotal members spaced apart from the first pair. This allows the tender to be held at two regions along its length and allows the individual pivotal members to be smaller than if only one pair of pivotal members was used. Where two moveable arms and two pairs of pivotal members are used, typically one arm carries a first pair of pivotal members and the second arm carries a second pair of pivotal members. In this case, the carriage means defined by the pairs of pivotal members will extend across the region encompassed by both arms.

The pivotal members may be pivotally attached to a carrying member rigidly fixed to the moveable arm. Desirably the carrying member may include angle adjustment means, such as a locking ring and screw, to set the angle of the pivotal member when in the first position.

The carriage means is preferably capable of carrying tenders in the weight range 75 kg to 400 kg. The launch apparatus is suitable for mounting on boats of sufficient size to carry additional watercraft, and thus is typically suitable for boats of at least 40 ft long. Whilst in theory there is no upper range to the length of boat with which the mechanism can be used, it is generally most suited to boats having a length in the range 40 ft to 120 ft.

The pivotal members may be in the form of angled blocks or chocks. The chocks are typically substantially triangular in cross-section, with the longest side of the chock forming the flat surface of the second position. The side forming the flat surface typically has a surface finish designed to match the surface of a bathing platform of a water vehicle on which the tender launch apparatus is to be mounted. The surface finish chosen will often be teak, although may be any other suitable surface for a marine environment.

The surface of the angled block which will adjoin a tender when the carriage means is in the first position, preferably has a resilient coating, such as rubber, so as to protect the tender from being damaged.

In accordance with another aspect of the invention, there is also provided a water vehicle on which is mounted launch apparatus comprising at least one moveable arm, wherein the moveable arm carries a carriage means moveable between a first position in which the carriage means is capable of holding a tender or personal watercraft and a second position in which it forms a flat surface, with the flat surface forming part of a bathing platform. The launch apparatus mounted on the water vehicle may comprise any one or any combination of the features as described above.

The invention will now be described, by way of example, and with reference to the following drawings in which.

Figure 5A:
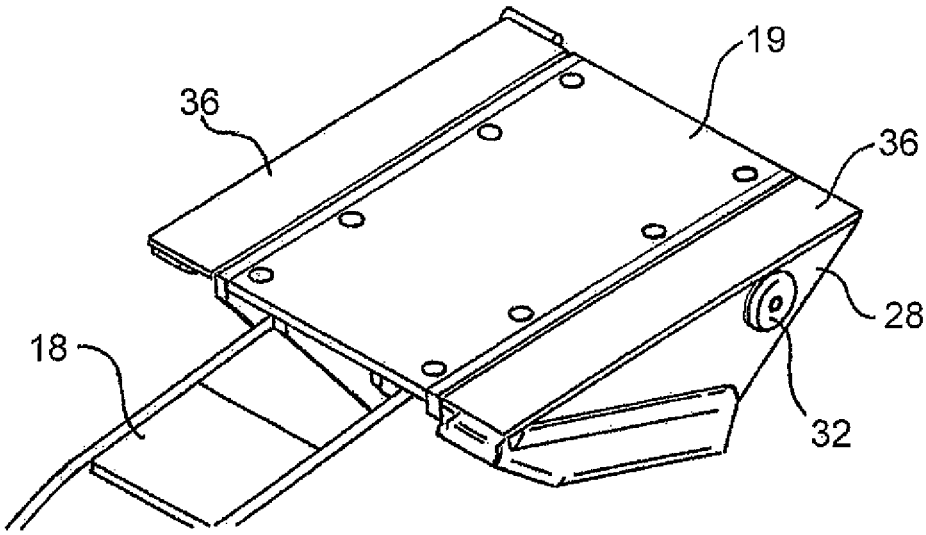
Figure 5B:
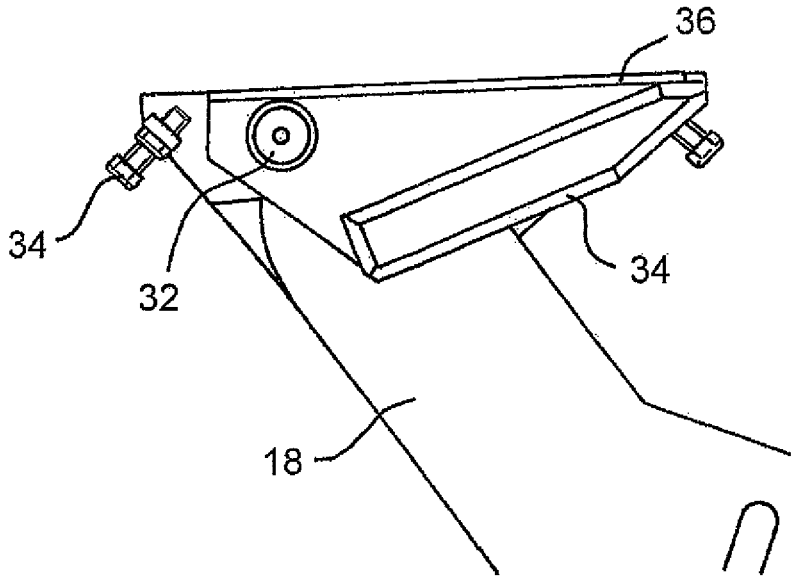
Figure 6:
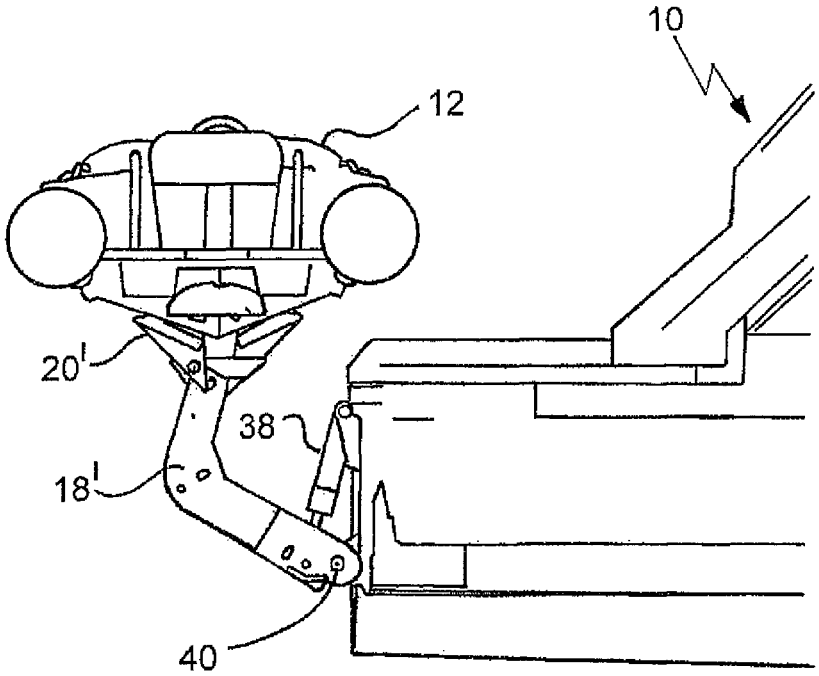
Figure 7:
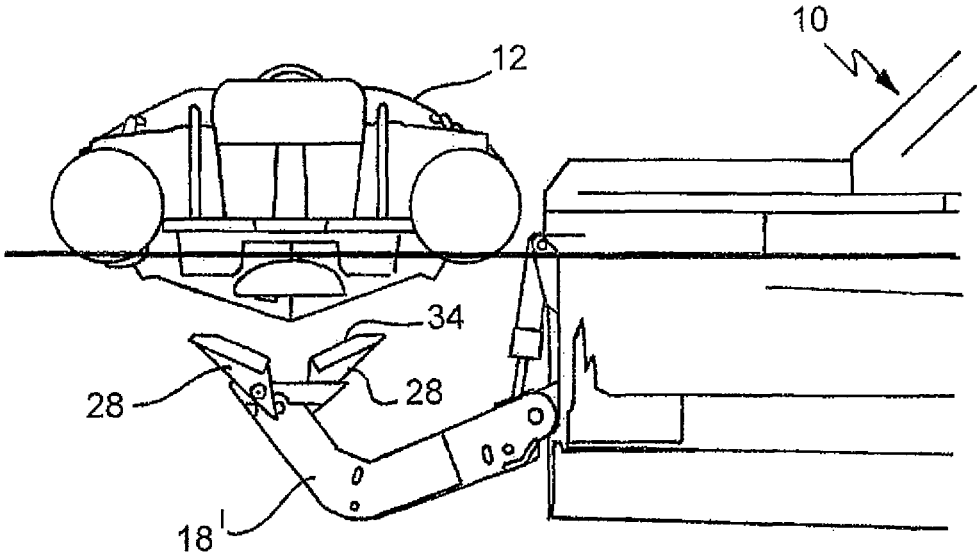

FIGS. 5*a* and 5*b* show a perspective and side views of the chock assembly in a closed position;

FIG. 6 shows a side view of the apparatus part deployed;

FIG. 7 shows the apparatus fully deployed; and

Figure 8:
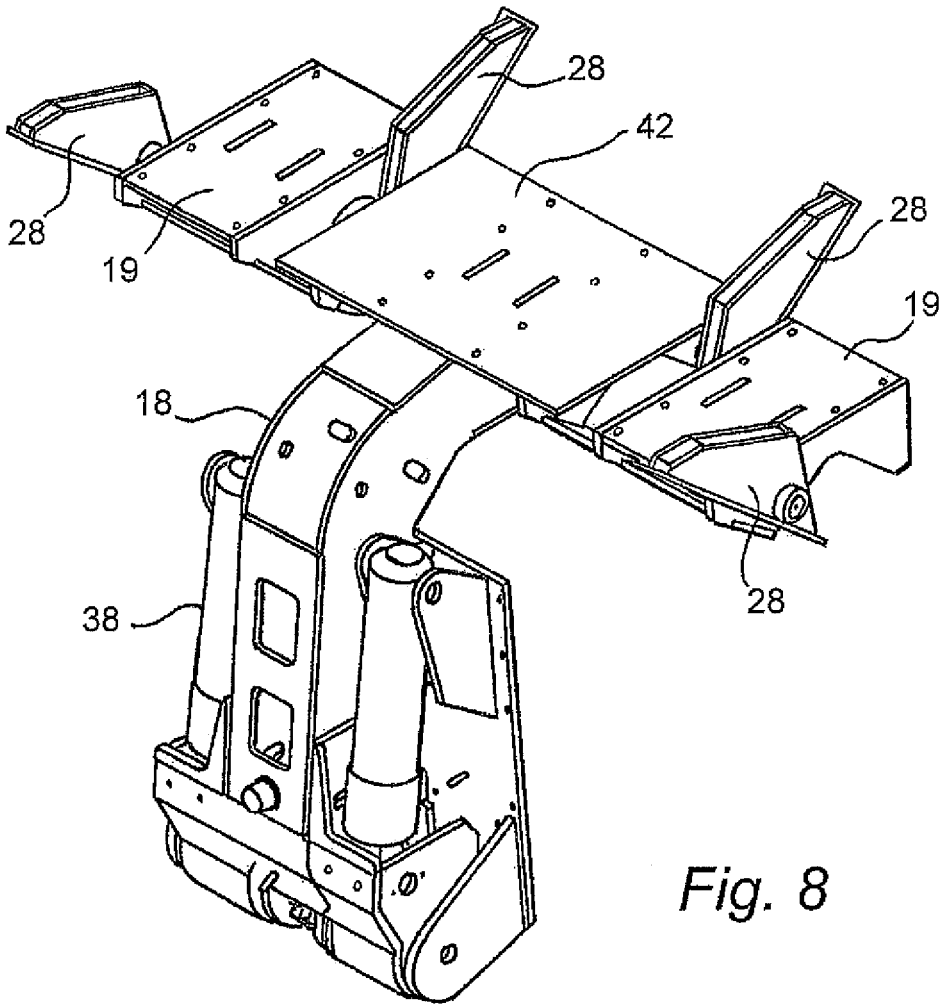

FIG. 8 shows another embodiment of the launch apparatus.

DESCRIPTION

Figure 1:
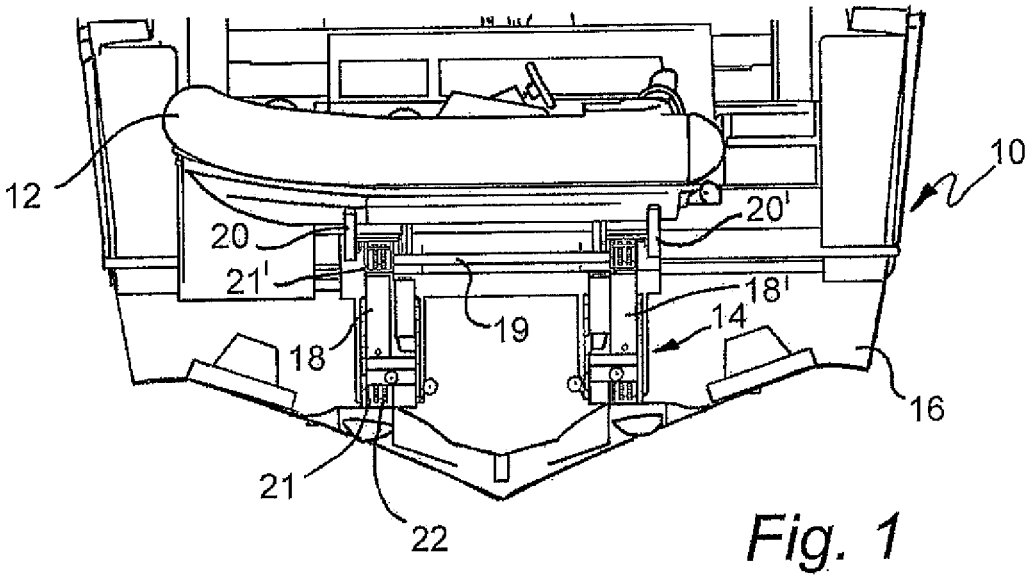
FIG. 1 shows a view from one end of a boat with launch apparatus stowed with the tender fitted.
Figure 2:
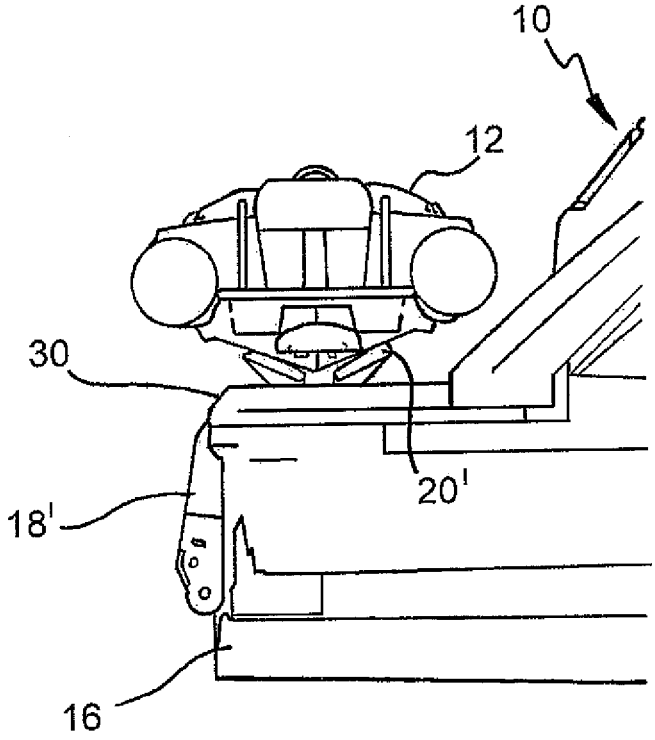
FIG. 2 shows a side view of the stowed apparatus with tender.

FIG. 1 shows a rear view of boat 10 of sufficient size to be able to carry a smaller watercraft, such as tender 12. Tender launch apparatus 14 is attached externally to the rear hull 16 of the boat 10 and comprises two hydraulically operated L-shaped arms 18, 18' to which are mounted saddle 19, with two pairs of angled chocks 20, 20' pivotally attached to saddle 19. The chock pairs 20, 20' form a v-shaped carriage to support tender 12 or other personal watercraft. In FIG. 1, the tender launch apparatus is in its stowed position with the tender mounted on the chock pairs 20, 20' directly above the boat's bathing platform 30, see FIG. 2. FIGS. 6 and 7 show the tender 12 as it is launched from the larger boat 10.

The two arm embodiment shown in FIG. 1 is used for larger boats over 55 ft. For smaller boats between 40 and 55 ft, a single arm mechanism can be used, as will be discussed later in relation to FIG. 8. The two arm mechanism is designed to accommodate tenders or personal watercraft up to 400 kg gross mass. The single arm mechanism is designed to accommodate tenders or personal watercraft up to 350 kg gross mass.

Figure 3:
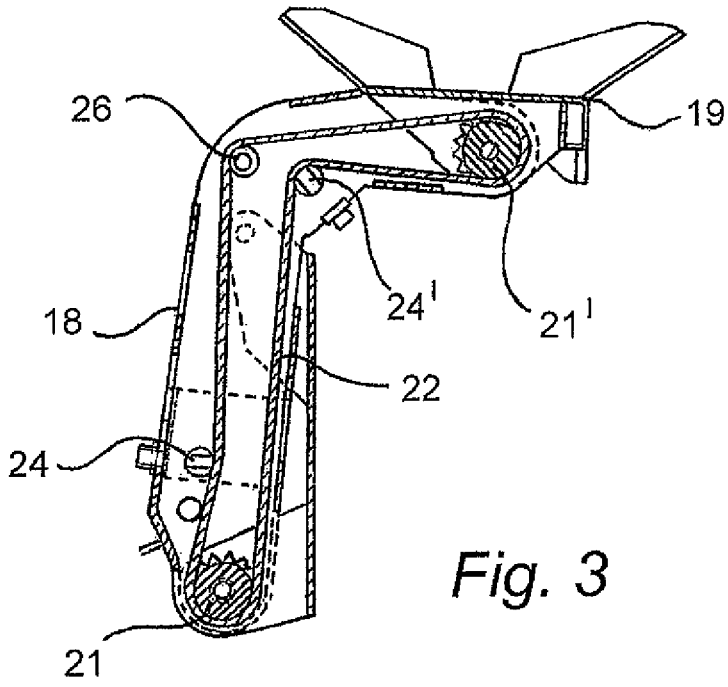
FIG. 3 shows a cross-sectional view of part of the apparatus showing a chock assembly in an open position for receiving a tender.

Each arm 18, 18' is made from a suitable material such as stainless steel or aluminium and as shown in FIG. 3 includes a gear assembly comprising gears 21, 21', heavy-duty chain 22, two chain tensioners, 24, 24', and roller 26. Gear 21' is connected to saddle 19, with the gear assembly ensuring that the position of the saddle 19 and chock pairs 20, 20' remains fixed to the horizontal regardless of the inclination of arms 18, 18'. This is important during launching and stowing of a tender as the tender needs to remain at a fixed position to the horizontal as arm 18 moves.

Figure 4:
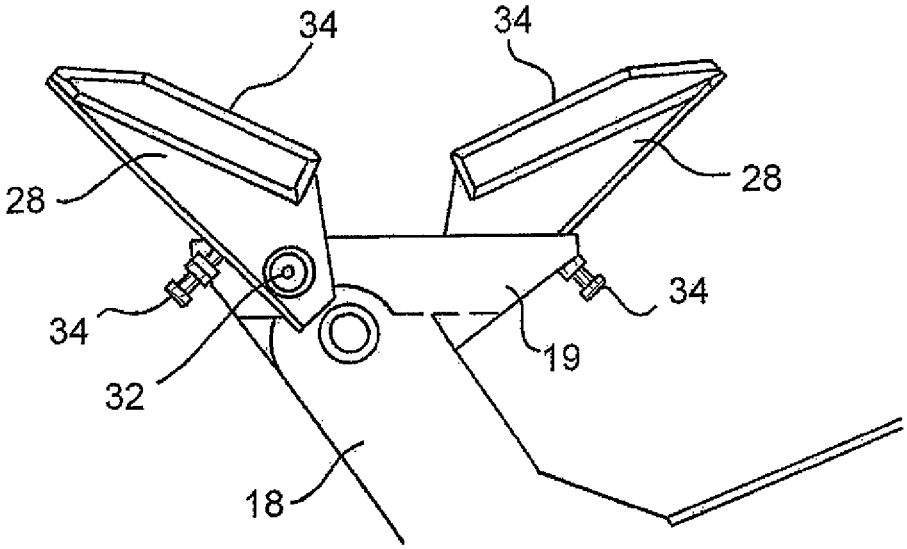
FIG. 4 shows a detailed view of the chock assembly which in the open position.

The saddle 19 and chock pairs 20, 20' form a chock assembly and the positions of the individual chocks are shown in detail in FIGS. 4, 5 and 6. Each chock 28 within the chock assembly comprises a substantially triangular cross-section block connected to saddle 19 by pivot point 32, with lock nut and screw combination 34 setting the angle of chock 28 when the apparatus is in the first opened position. By manually adjusting the depth of screw 34, the angle of chock 28 can be changed to accommodate different watercraft and tender hull shapes. Each chock 28 within the chock pair 20, 20' is laterally displaced from the other chock 28, as can be seen in FIG. 4, and the inwards angle of the chocks defines a v-shaped guide or channel. The two chock pairs 20, 20' between them define a v-shaped carriage capable of securely holding the tender 12 when the tender is stowed on board and held within the launch apparatus 14. The lock nut and screw arrangement allows the assembly to accommodate most tender or personal watercraft hull forms as the internal angle of the v-shaped guide can be altered over a wide range.

After deployment of the tender 12 and stowing the launch apparatus 14, the chocks 28 are rotated by pivot point 32 until they are in the flat second position, and saddle 19 and chock pairs 20, 20' form part of the bathing platform 30.

In the open or inclined position shown in FIG. 4, the uppermost face of chock 28 has a rubber-faced surface 34 so as to protect the gel-coat of the tender hull when it sits within the carriage. In the second closed position shown in FIGS. 5*a* and 5*b*, the uppermost surface 36 along the longest edge of the triangular cross-section chock 28 is teak-clad so that it presents a uniform appearance when compared with the bathing platform 30. The saddle 19 is also clad in teak on its upper surface.

As can be seen from FIGS. 6 and 7, deployment of the tender 12 into the water is achieved by movement of arms 18, 18' which are hydraulically operated by rams 38. The hydraulic arms 18, 18' pivot outwards and downwards from pivot point 40 with the gear assembly ensuring that the tender remains horizontal with the arms in any position. Once the hydraulic rams 38 are fully extended and the arms 18, 18' and chock pairs 20, 20' are fully submerged, the tender 12 floats freely. After deployment of the tender 12, the hydraulic arms 18, 18' are raised to return the chock assembly to the original stowed position. The chocks 28 are then adjusted from the first inclined position by manually pushing against each chock so that it rotates about pivot point 32 and folds into a flat position, see FIG. 5*a*. The chock assembly then forms an integral part of the bathing platform 30, with no space being lost on the boat platform or lost within the boat hull to accommodate the launch apparatus.

Where a single arm mechanism is provided for a smaller boat, see FIG. 8, a cross-beam 42 is fitted with two chock assemblies at its extremities, each assembly comprising a saddle 19 and two chocks 28 in a similar manner as discussed in relation to the two arm mechanisms.

The invention as described allows for launching a tender or personal watercraft from the bathing platform of a powered pleasure boat whilst avoiding any reduction in the usable internal hull length and avoiding any reduction in the bathing platform area available once the tender has been launched. Thus using the present invention, a 58 ft boat will provide 58 feet of accommodation within its hull and because the hydraulic arms are attached to the external surface of the hull, space for a crew cabin is retained. Once the tender or personal watercraft has been deployed, and the launch mechanism retracted back on board, a clean bathing platform is provided with no upstanding machinery and the nominal height of the bathing platform is maintained, which avoids compromising access to stern gear assemblies such as rudders.

The invention claimed is:

1. Launch apparatus comprising at least one moveable arm mountable on a water vehicle, wherein the moveable arm carries a carriage means moveable between a first position in which the carriage means is capable of holding a personal watercraft and a second position in which the carriage means forms a flat surface, the carriage means comprising a first pair of pivotal members which in the first position form a substantially v-shaped guide or channel for receiving a personal watercraft, each pivotal member comprising a chock having a first side and a second side, the first side of the chock adapted to form the flat surface of the carriage means when the carriage means is in the second position, the first side having a finish designed to match the surface of a bathing platform, the second side of the chock adapted to adjoin the personal watercraft when the carriage means is in the first position, the second side having a resilient coating, the moveable arm including a gear assembly adapted to maintain the carriage means in a substantially constant orientation to the horizontal while the carriage means is in the first position regardless of the orientation of the moveable arm.

2. Launch apparatus according to claim 1, further comprising said at least one movable arm is two moveable arms.

3. Launch apparatus according to claim 1, wherein the moveable arm is mountable externally on a boat hull.

4. Launch apparatus according to claim 3, wherein the carriage means is pivotally moveable relative to the arm, pivoting between the first and second positions.

5. Launch apparatus according to claim 1, wherein the angle between the pivotal members is adjustable to accommodate a plurality of shapes of personal watercraft.

6. Launch apparatus according to claim 1, wherein the carriage means is capable of carrying tenders in the weight range 75 kg to 400 kg.

7. Launch apparatus according to claim 1, wherein the moveable arm is movable between a stowed position and a launch position, the gear assembly adapted to maintain the carriage means in the substantially constant orientation as the moveable arm moves between the stowed position and the launch position.

8. Launch apparatus according to claim 1, wherein the gear assembly comprises a first gear, a second gear and a chain operatively coupling the second gear to the first gear.

9. Launch apparatus according to claim 8, wherein the carriage means includes a saddle pivotally coupled to the moveable arm, the second gear of the gear assembly being connected to the saddle, whereby the gear assembly maintains the saddle in a substantially constant orientation to the horizontal regardless of the orientation of the moveable arm.

10. Launch apparatus according to claim 9, wherein the gear assembly includes a roller and at least one chain tensioner in engagement with the chain.

* * * * *